US007266047B2

(12) United States Patent
Chan

(10) Patent No.: US 7,266,047 B2
(45) Date of Patent: Sep. 4, 2007

(54) TIME ALARM

(75) Inventor: Raymond Chan, Hunghom (HK)

(73) Assignee: IDT Technology Limited, Hunghom, Kowloon (HK)

( * ) Notice: Subject to any disclaimer, the term of this patent is extended or adjusted under 35 U.S.C. 154(b) by 163 days.

(21) Appl. No.: 10/950,539

(22) Filed: Sep. 28, 2004

(65) Prior Publication Data

US 2006/0067165 A1 Mar. 30, 2006

(51) Int. Cl.
*G04B 47/00* (2006.01)
*A47G 9/00* (2006.01)

(52) U.S. Cl. ..... 368/10; 368/12; 5/639; 5/904

(58) Field of Classification Search ..... 368/12, 368/73, 230, 250, 276, 283, 298, 309, 312, 368/10; 5/639, 904
See application file for complete search history.

(56) References Cited

U.S. PATENT DOCUMENTS 5,144,600 A * 9/1992 Cheng ..... 368/12
5,262,763 A * 11/1993 Okuyama et al. ..... 345/87
5,469,411 A 11/1995 Owen
5,686,882 A * 11/1997 Giani ..... 340/407.1
5,737,692 A 4/1998 Lang
5,764,594 A * 6/1998 Berman et al. ..... 368/12
5,894,455 A 4/1999 Sikes
6,151,278 A 11/2000 Najarian
6,236,621 B1 * 5/2001 Schettino ..... 368/10
2003/0117272 A1 * 6/2003 Fegley et al. ..... 340/309.3
2005/0105399 A1 * 5/2005 Strumpf et al. ..... 368/47

* cited by examiner

*Primary Examiner*—Vit Miska
*Assistant Examiner*—Jeanne-Marguerite Goodwin
(74) *Attorney, Agent, or Firm*—Leydig, Voit & Mayer, Ltd.

(57) ABSTRACT

A vibrational alarm device for use in combination with an alarm clock, includes a receiver for receiving a RF alarm signal transmitted by the alarm clock, an operating circuit for providing an operating signal in response to the receiver receiving the alarm signal, and an electro-mechanical vibrator for vibration in response to the operating signal provided by the operating circuit. A casing houses the receiver, the operating circuit, and the vibrator for vibration by the vibrator to provide a vibrational alarm signal.

11 Claims, 7 Drawing Sheets

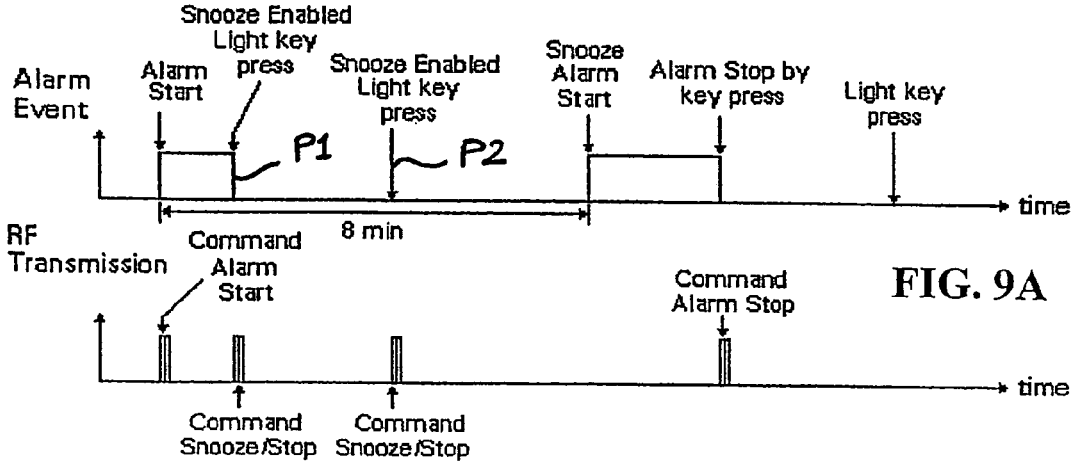
FIG. 9A
FIG. 9B
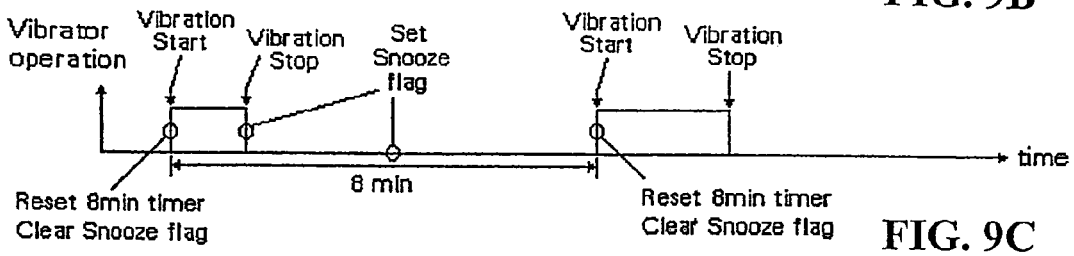
FIG. 9C
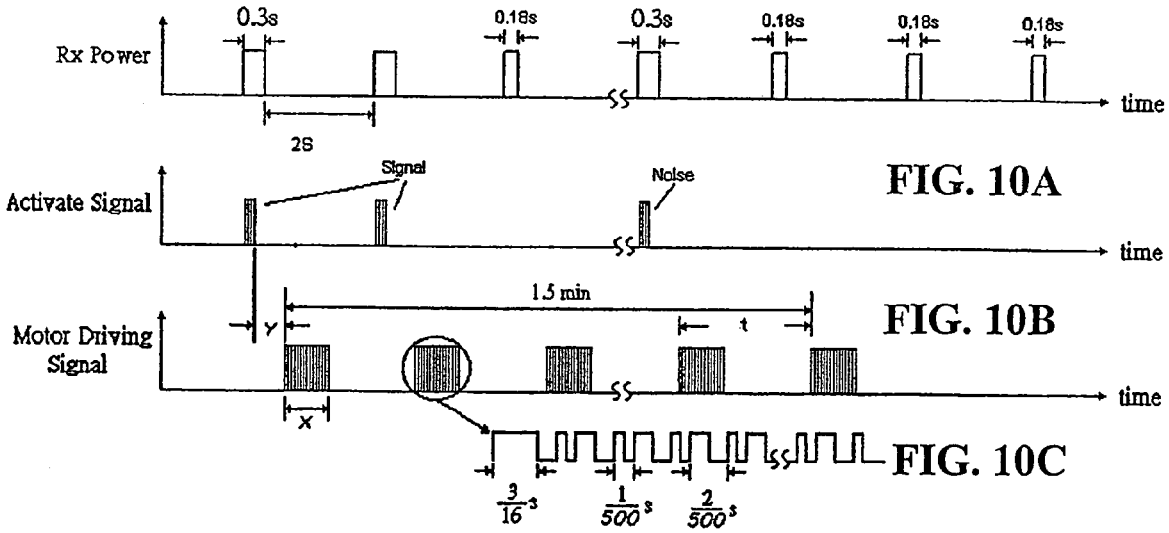
FIG. 10A
FIG. 10B
FIG. 10C

TIME ALARM

The subject invention relates to an alarm device for use with an alarm clock or the like.

BACKGROUND OF THE INVENTION

Alarm signals of many timer alarms are audible. The sound of such signals can be disturbing to others and especially to one's partner in the case of a wake-up alarm.

The invention seeks to obviate or at least alleviate such a shortcoming by providing a new or improved time alarm device.

SUMMARY OF THE INVENTION

According to the invention, there is provided an alarm device for use in combination with an alarm clock, comprising a receiver for receiving a wireless alarm signal transmitted by said alarm clock, an operating circuit associated with the receiver for providing an operating signal in response to the receiver receiving said alarm signal, and an electromechanical vibrator associated with the operating circuit for vibration in response to the operating signal provided by the operating circuit. There is also a casing housing the receiver, the operating circuit and the vibrator for vibration by the vibrator to thereby provide a vibrational alarm signal.

Preferably, the receiver comprises a radio frequency receiver for receiving a radio frequency alarm signal transmitted by said alarm clock.

It is preferred that the receiver is arranged to operate in an intermittent manner.

It is preferred that the operating circuit is arranged to enable the receiver periodically for intermittent operation.

More preferably, the interval between two successive operations of the receiver is shorter than the duration of the alarm signal transmitted by said alarm clock.

More preferably, the alarm signal transmitted by said alarm clock comprises a data pack containing a series of packs of repeating data.

It is preferred that the operating signal provides a series of pulses as a driving signal for driving the vibrator.

It is preferred that the operating circuit comprises a control circuit connected to the receiver for providing the operating signal and a driver circuit for providing a pulsating driving signal to drive the vibrator in response to the operating signal.

More preferably, the driving signal comprises a series of pulses each comprising a series of shorter pulses.

In a specific construction, the vibrator comprises an electric motor having an output shaft and a weight supported on the shaft for rotation in an imbalanced manner.

Preferably, the casing has a generally flat profile.

Preferably, the casing has a fully enclosing outer surface provided without any operating keys or buttons.

More preferably, the casing has an inner surface provided with an operating key or button and includes a detachable outer cover covering the key or button.

BRIEF DESCRIPTION OF DRAWINGS

The invention will now be more particularly described, by way of example only, with reference to the accompanying drawings, in which:

FIGS. 9A to 9C are schematic diagrams showing alarm event, RF transmission and vibrator operation relating to the use of the alarm device of FIG. 1; and FIGS. 10A to 10C are schematic diagrams showing receiver power, activate signal and motor driving signal relating to the use of the alarm device of FIG. 1.

DETAILED DESCRIPTION OF PREFERRED EMBODIMENT

Figure 1:
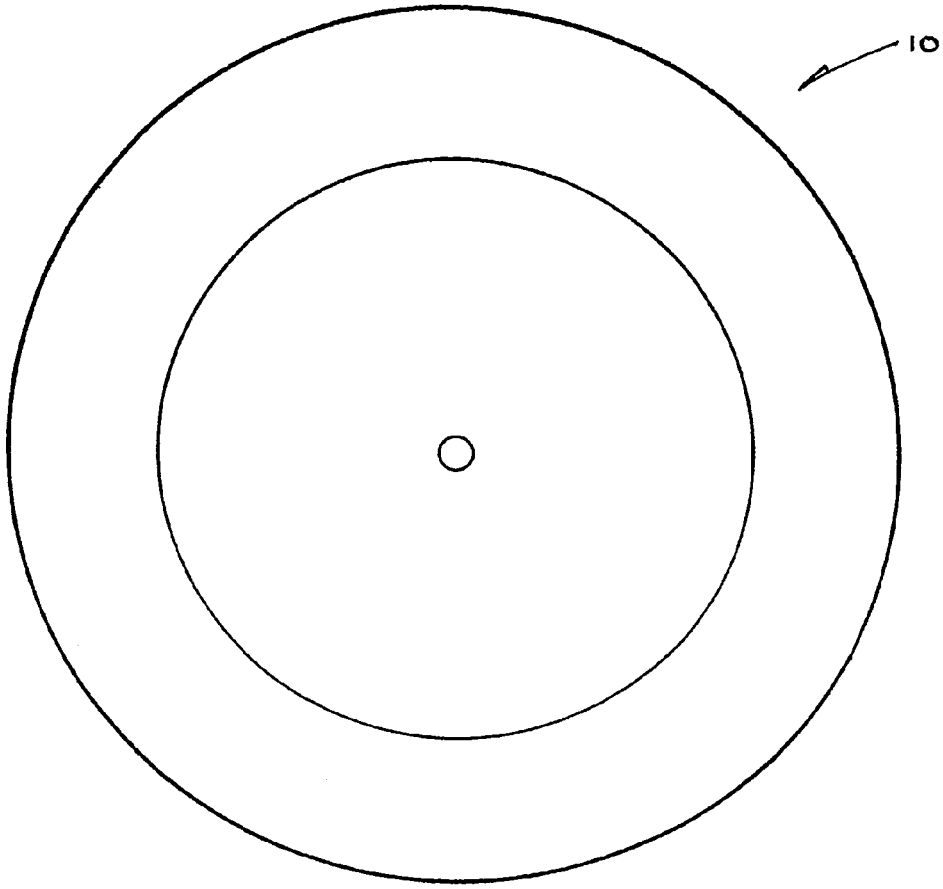
FIG. 1 is a bottom plan view of an embodiment of an alarm device in accordance with the invention.
Figure 2:
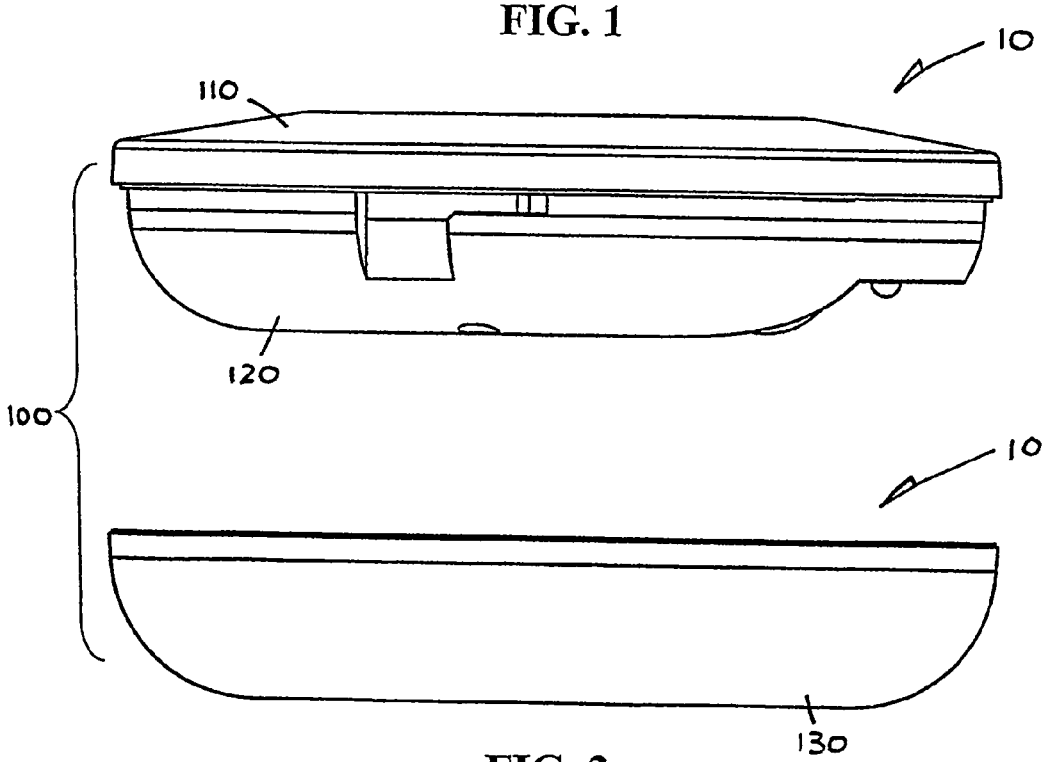
FIG. 2 is a part-exploded side view of the alarm device of FIG. 1.
Figure 4:
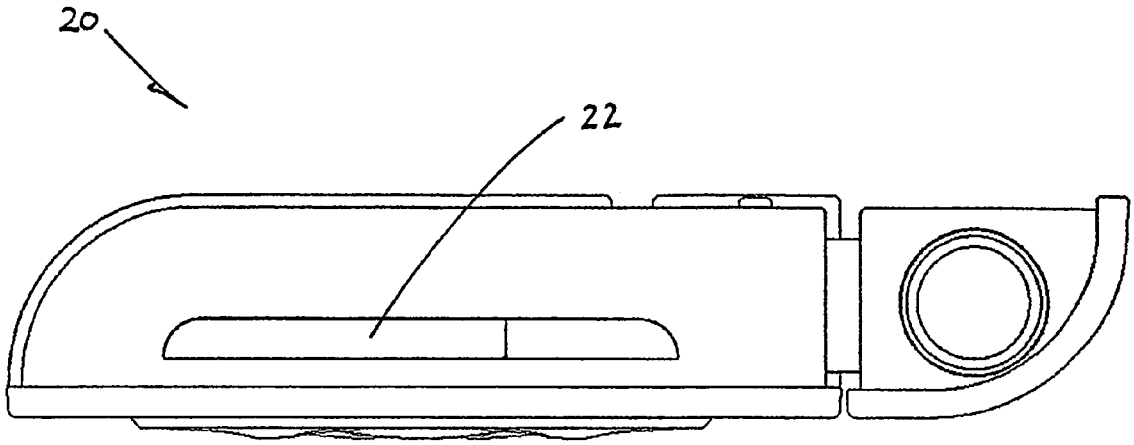
FIG. 4 is a top plan view of the alarm clock of FIG. 3.
Figure 3:
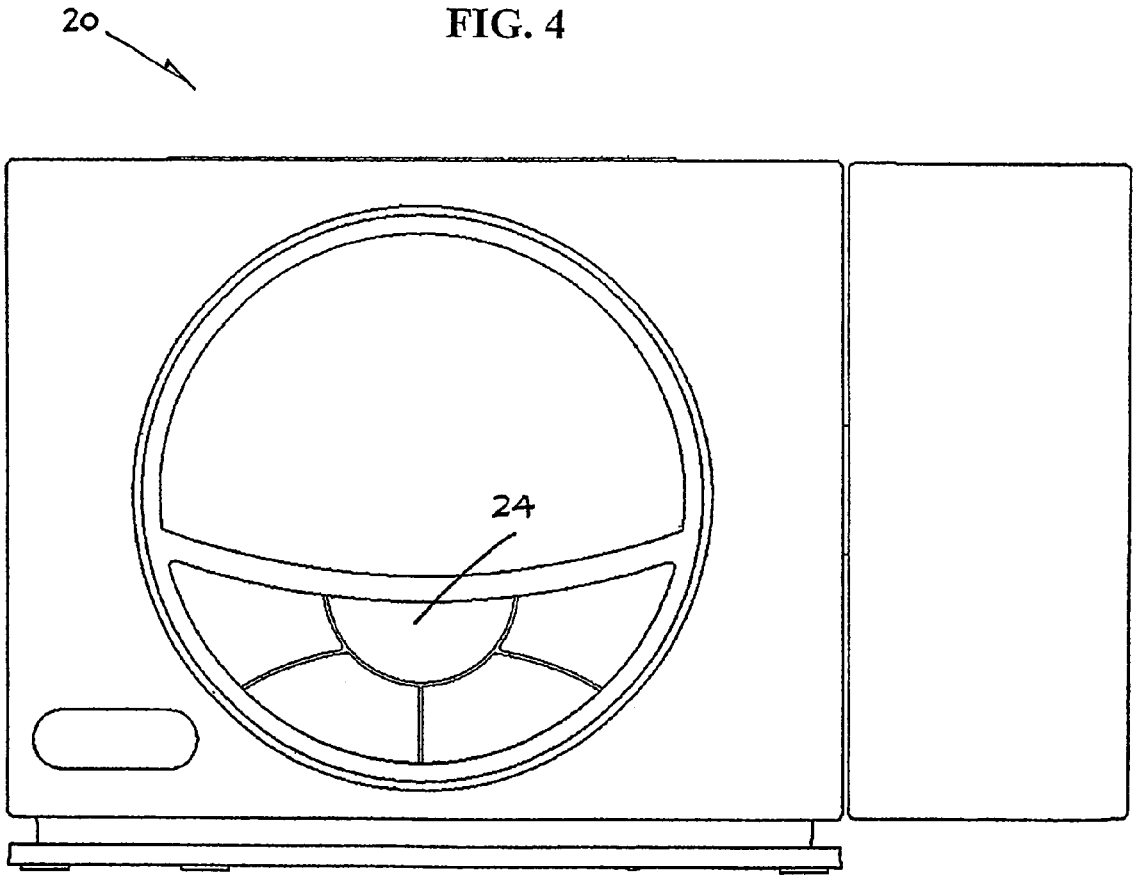
FIG. 3 is a front view of an alarm clock for use with the alarm device of FIG. 1.
Figure 5:
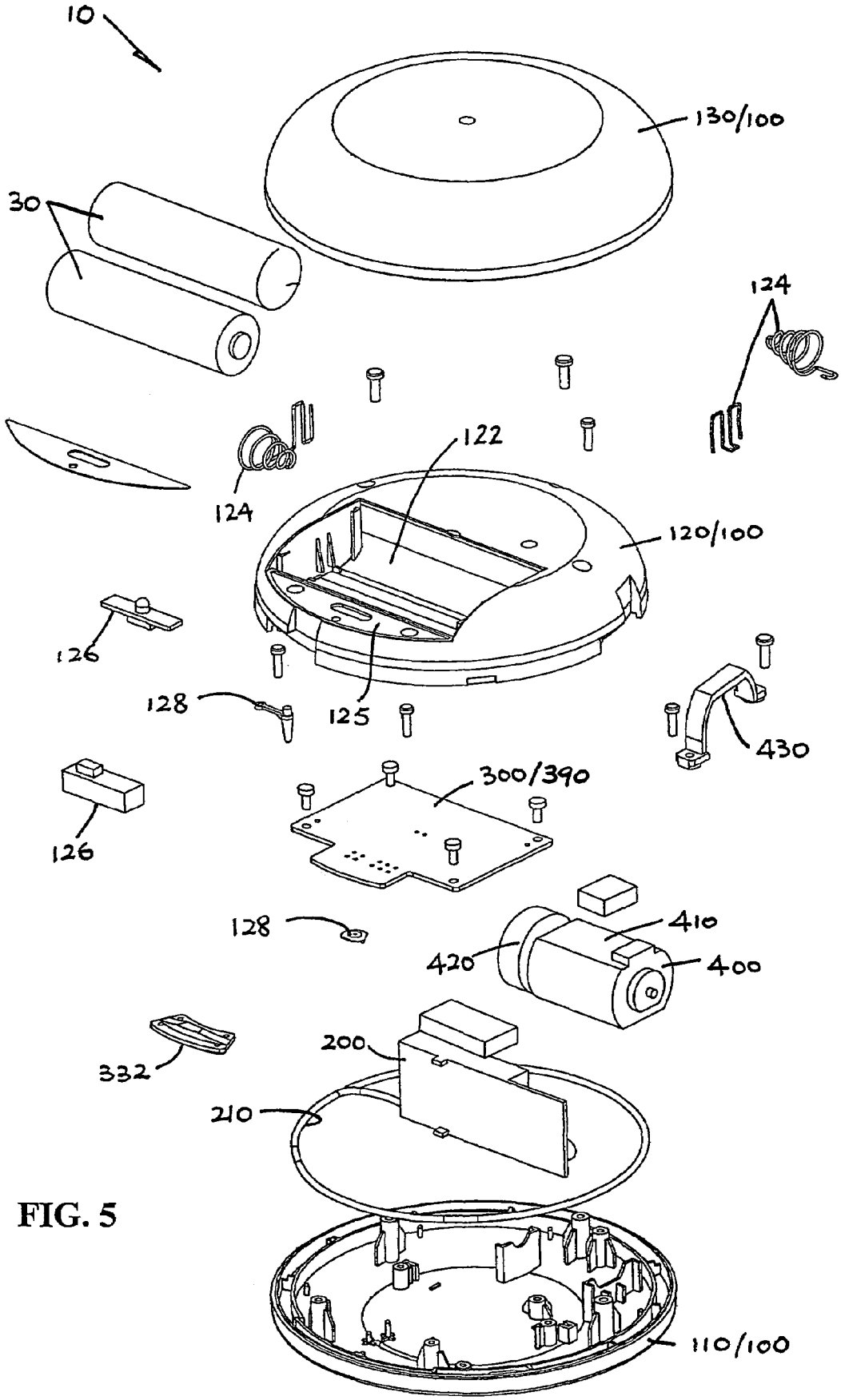
FIG. 5 is an exploded perspective view of the alarm device of FIG. 1.
Figure 6:
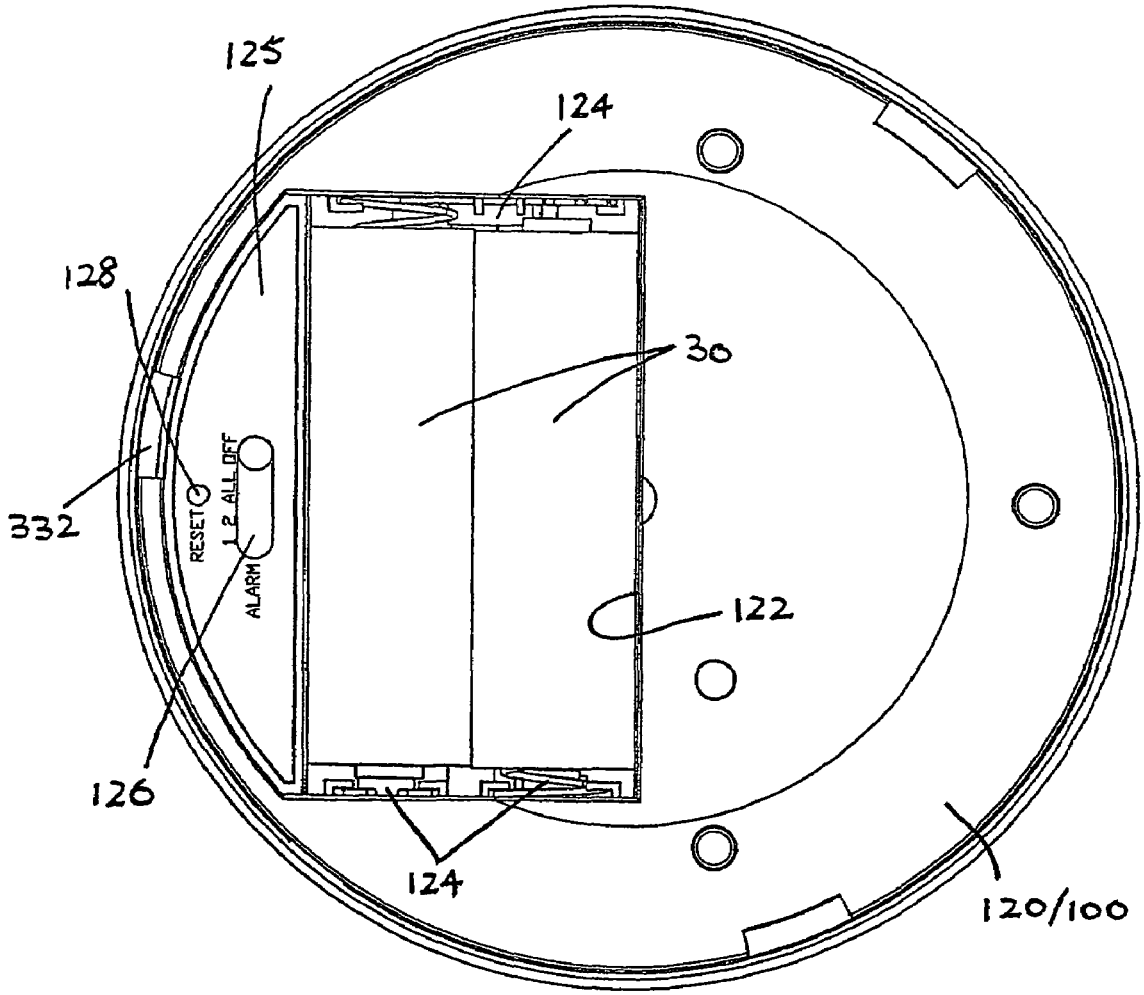
FIG. 6 is a bottom plan view of the alarm device of FIG. 1, with a bottom cover thereof detached.
Figure 7:
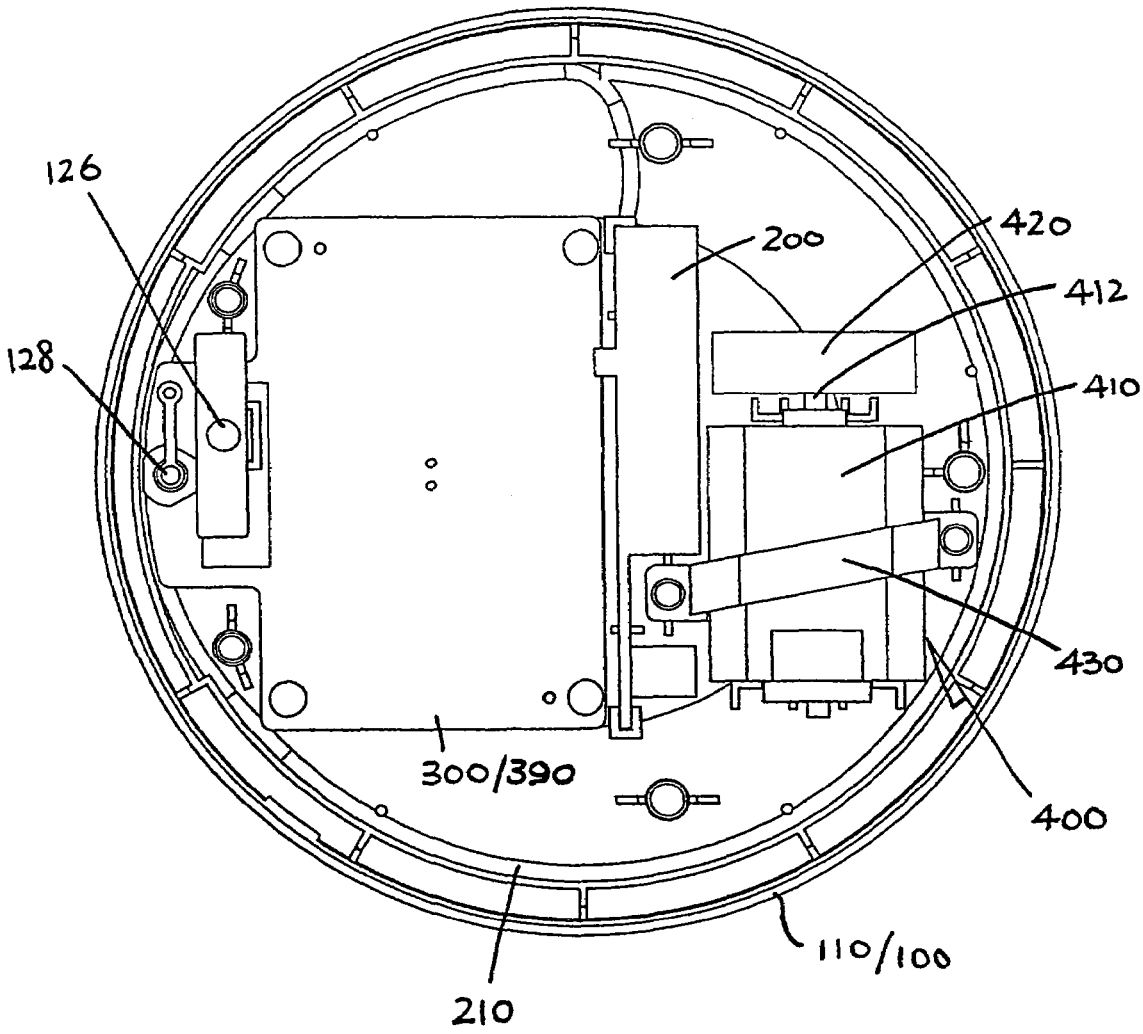
FIG. 7 is a bottom plan view corresponding to FIG. 6, with a bottom casing of the alarm device also detached.
Figure 8:
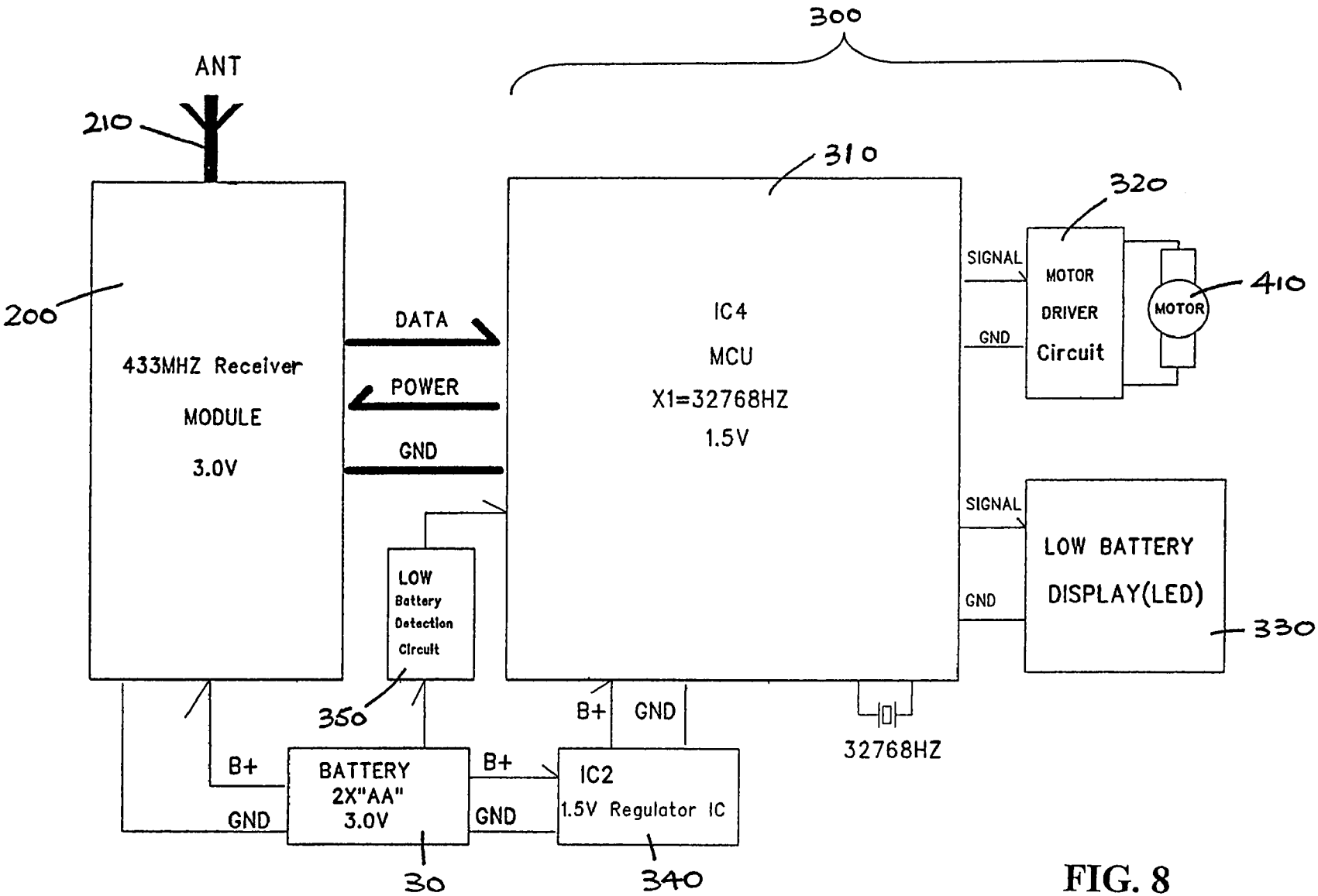
FIG. 8 is a circuit diagram of the operating circuitry of the alarm device of FIG. 1.

Referring to the drawings, there is shown an alarm device 10 embodying the invention for use in combination with an alarm clock 20 in a wireless manner. The alarm clock 20 has a snooze/light button 22 and an alarm setting mode key 24, and incorporates a radio frequency (RF) transmitter for transmitting an RF alarm signal at a frequency of 433 MHz at a preset alarm time. The alarm device 10 comprises a generally flat and round casing 100, an RF receiver 200, an electronic operating circuit 300 mounted on a circuit board (PCB) 390 and an electro-mechanical vibrator 400. The casing 100 is circular disc-like, formed by a pair of top and bottom shells 110 and 120 that are fixed together by screws and a detachable bottom cover 130 that covers the bottom shell 120.

The top and bottom shells 110 and 120 together house and encase the RF receiver 200, the operating circuit 300 and the vibrator 400. On its outer side the bottom shell 120 provides a recessed compartment 122 fitted with contacts 124 for holding two 1.5V battery cells 30, which is closed by the bottom cover 130. On a land 125 adjacent the compartment 122 there are a selector slide switch 126 and a reset press key 128, both of which can only be accessed after the bottom cover 130 has been detached. An LED lens 332 is located on the outer periphery of the land 125 for low battery indication, which is visible through the interface between the casing shells 110 and 120 and the cover 130.

The casing 100 has a generally flat profile as depicted, designed to be use in the bed especially under a pillow. It has a fully enclosing outer surface that is provided without any operating keys or buttons to prevent the user stopping or snoozing an alarm signal by manipulating the alarm device 10, which is all too conveniently or closely placed, without the need of getting to the alarm clock 20 as is customarily necessary.

The vibrator 400 is constructed by an electric motor 410 having an output shaft 412 and an eccentric weight 420 in the form of a wheel supported on the shaft 412 for rotation in an imbalanced manner and hence vibration. The motor 410 is mounted fast by a bracket 430 on the top shell 110 so as to vibrate or impart vibration to the overall casing 100 or alarm device 10 to thereby provide a vibrational alarm signal.

The RF receiver 200 includes an antenna 210 extending internally around the casing 100 and is tuned to the frequency of 433 MHz for receiving an RF alarm signal emitted by the transmitter of the alarm clock 20.

The operating circuit 300 is implemented based on a MCU control circuit 310 operating at a clock speed of 32,768 Hz, and includes a motor driver circuit 320 and a lower battery display circuit 330 connected thereto. The RF receiver 200 is connected to the control circuit 310 for co-operation. The motor 410 and two green and red LEDs (not shown) are connected to the driver circuit 320 and the lower battery display circuit 330 respectively for energization. The RF receiver 200 is directly connected to the batteries 30 for operation at 3V, whereas the control circuit 310 is connected thereto via a voltage regulator 340 for operation at a reduced voltage of 1.5V. A low battery detection circuit 350 is connected between the batteries 30 and the control circuit 310 for co-operation with the low battery display circuit 330, whereby the green LED (blinking) will be switched to the red LED (blinking) when the batteries 30 run low.

The alarm clock 20 offers two 24-hour alarms which the alarm device 10 can select for response using the selector switch 126 as between the two alarms (1 and 2) or both (ALL) or none (OFF). The alarm clock 20 can set either alarm using the alarm setting mode key 24 and other keys as necessary. At the preset time, the clock transmitter will transmit an RF alarm start command (FIG. 9B) for operating the alarm device 10 i.e. to vibrate.

Upon receipt of the alarm start command, the RF receiver 200 of the alarm device 10 will notify the control circuit 310, which in turn will trigger the driver circuit 320. Upon trigger, the driver circuit 320 will generate a motor driving signal (FIG. 10C) for driving the motor 410 to set the overall vibrator 400 into operation, whereupon the alarm device 10 vibrates to provide a vibrational alarm signal for example from under the pillow of a user. The entire vibrational alarm signal will last for about 1.5 minutes and will not be repeated unless the snooze button 22 on the alarm clock 20 is pressed before the alarm signal expires (P1 in FIG. 9A) or else within about 8 minutes from the original preset alarm time (P2 in FIG. 9A), in which case the vibrator 400 will automatically vibrate again at the end of the said 8 minutes period (FIG. 9A or 9C).

Pressing of the snooze button 22 will cause the clock transmitter to transmit a snooze/stop command and/or a set snooze command, which will be processed by the alarm device 10 (i.e. the RF receiver 200 and control circuit 310, etc.) to stop the vibrator 400 if necessary and/or to set the vibrator 400 into action again to provide a snooze alarm within the said 8 minutes period. The start of each vibration, whether it be the first or a snooze alarm, will reset a timer for the said 8 minutes period and clear the snooze flag (FIG. 9C). Most of the other keys of the alarm clock 20 may be pressed to stop the vibrational alarm signal while it is being given, in which case the alarm clock 20 will transmit a relevant RF alarm stop command to the alarm device 10 for Action.

For power saving, the control circuit 310 of the alarm device 10 will only enable or turn on the RF receiver 200 periodically for intermittent operation to search for an RF activate signal (FIG. 10B) from the alarm clock 20 (i.e. one of the aforesaid alarm commands) for a short interval (0.18 second) every 2 seconds (FIG. 10A). Upon receiving an activate signal, the RF receiver 200 will stay on for a longer period of time (0.3 second) as required for processing and responding to the signal.

Every alarm command is transmitted as a data pack over a length of time of about 5 seconds, containing a series of 130 packs of the same or repeating data. As the interval between two successive operations (i.e. 2 seconds) of the RF receiver 200 is shorter than the transmission duration of the alarm command (i.e. 5 seconds), there will be at least two opportunities (as illustrated by the two "signal" in FIG. 10B) for at least one of the many data packs in the alarm command to be successfully received by the RF receiver 200. This would minimize the chance of failure in reception by the alarm device 10 for environmental reasons.

The motor driving signal generated by the driver circuit 320 to drive the motor 410 is not flat DC but a pulsating DC signal (FIG. 10C) for optimum performance i.e. maximum mechanical power output for minimum electrical power input. The driving current is in the form of a series of main pulses occupying a duration of about 1.5 minutes, each having a pulse width x of about 0.3 second and they repeat at a period t of about 2.3 seconds (y denotes delay in start of vibration). The pulse width x determines the intermittent ON time of the motor 410. The main pulses each comprise a series of much shorter subsidiary pulses as depicted, which determine the vibration pattern or tone.

Alert signals based on vibration have of course been known, for example as used in mobile phones. Experience shows that vibrational alert or alarm signals are often more interruptive and less likely to be ignored or to go unnoticed. Vibrational alarms, that being physical or mechanical, are believed to be more effective in waking up people than mere noise i.e. conventional audio alarms. By separating the alarm device 10 from the alarm clock 20, one has to look for the alarm clock 20 in order to snooze or stop vibration of the alarm device 10, and this can be quite wakening.

The invention has been given by way of example only, and various modification of and/or alterations to the described embodiment may be made by persons skilled in the art without departing from the scope of the invention as specified in the appended claims.

The invention claimed is:

1. An alarm device for use in combination with an alarm clock, comprising:

a receiver for receiving a wireless alarm signal transmitted by an alarm clock;

an operating circuit associated with the receiver for providing an operating signal in response to the receiver receiving the alarm signal;

an electro-mechanical vibrator associated with the operating circuit for vibration in response to the operating signal provided by the operating circuit; and a casing including first and second shells housing, when joined together, the receiver, the operating circuit, and the vibrator, the first shell being vibrated by the vibrator to provide a vibrational alarm signal, the second shell including a surface on which an operating key or a button for controlling the operating circuit is exposed, and an outer cover attachable to and completely detachable from the second shell, covering the operating key or a button when the outer cover is attached to the second shell so that the casing has an outer surface enclosing the alarm device and free of any exposed operating keys and buttons for controlling the alarm device.

2. The alarm device as claimed in claim 1, wherein the receiver comprises a radio frequency receiver for receiving a radio frequency alarm signal transmitted by the alarm clock.

3. The alarm device as claimed in claim 1, wherein the receiver operates intermittently.

4. The alarm device as claimed in claim 3, wherein the operating circuit enables the receiver periodically for intermittent operation.

5. The alarm device as claimed in claim 3, wherein the interval between two successive operations of the receiver is shorter than duration of the alarm signal transmitted by the alarm clock.

6. The alarm device as claimed in claim 5, wherein the alarm signal transmitted by alarm clock comprises a data packet containing a series of packets of repeating data.

7. The alarm device as claimed in claim 1, wherein the operating signal provides a series of pulses as a driving signal for driving the vibrator.

8. The alarm device as claimed in claim 7, wherein the driving signal comprises a series of pulses, each pulse comprising a series of shorter pulses.

9. The alarm device as claimed in claim 1, wherein the operating circuit comprises a control circuit connected to the receiver for providing the operating signal and a driver circuit for providing a pulsating driving signal to drive the vibrator in response to the operating signal.

10. The alarm device as claimed in claim 1, wherein the vibrator comprises an electric motor having an output shaft and a weight supported on the shaft for rotation in an imbalanced manner.

11. The alarm device as claimed in claim 1, wherein the casing has a generally flat profile.

* * * * *